US009138908B2

(12) United States Patent
Petersen et al.

(10) Patent No.: US 9,138,908 B2
(45) Date of Patent: Sep. 22, 2015

(54) MATERIAL TRIMMER WITH CUT-LINE INDICATOR

(75) Inventors: Sean T. Petersen, Evansville, WI (US); David C. Eby, Madison, WI (US); Theodore Jach, Cambridge, WI (US); Doug Birkholz, Madison, WI (US)

(73) Assignee: Fiskars Brands, Inc., Madison, WI (US)

( * ) Notice: Subject to any disclaimer, the term of this patent is extended or adjusted under 35 U.S.C. 154(b) by 944 days.

(21) Appl. No.: 12/473,954

(22) Filed: May 28, 2009

(65) Prior Publication Data

US 2009/0293694 A1 Dec. 3, 2009

Related U.S. Application Data

(60) Provisional application No. 61/058,138, filed on Jun. 2, 2008.

(51) Int. Cl.

| | |
|---|---|
| ***B26D 1/06*** | (2006.01) |
| ***B26D 7/01*** | (2006.01) |
| *B26D 1/04* | (2006.01) |
| *B26D 7/02* | (2006.01) |
| *B26D 7/00* | (2006.01) |

(52) U.S. Cl.

CPC . *B26D 7/015* (2013.01); *B26D 1/04* (2013.01); *B26D 1/065* (2013.01); *B26D 7/025* (2013.01); *B26D 2007/0087* (2013.01); *Y10T 83/856* (2015.04); *Y10T 83/863* (2015.04); *Y10T 83/8822* (2015.04)

(58) Field of Classification Search

USPC ..... 83/483, 485, 522.11, 522.15, 455, 83/522.16, 522.17, 522.22, 522.23, 83/522.24, 583, 584, 614

IPC ..... B26D 7/0006

See application file for complete search history.

(56) References Cited

U.S. PATENT DOCUMENTS

| | | | | | |
|---|---|---|---|---|---|
| 1,786,925 | A | * | 12/1930 | Wiegelmann | 83/508.3 |
| 2,037,856 | A | | 4/1936 | Filippi | |
| 2,510,471 | A | * | 6/1950 | Horstkotte | 83/508.3 |
| 3,097,557 | A | | 7/1963 | Langstaff | |
| 3,213,735 | A | * | 10/1965 | Walter et al. | 83/353 |
| 3,368,597 | A | * | 2/1968 | Carter | 83/425.3 |
| 3,410,994 | A | * | 11/1968 | Facto | 362/89 |
| 3,638,692 | A | * | 2/1972 | Carter et al. | 353/80 |
| 3,821,916 | A | | 7/1974 | Ricci et al. | |
| 4,281,571 | A | | 8/1981 | Yates | |

(Continued)

FOREIGN PATENT DOCUMENTS

| | | |
|---|---|---|
| EP | 1 683 613 A1 | 7/2006 |
| WO | WO2007/133657 | 11/2007 |

*Primary Examiner* — Kenneth E Peterson

(74) *Attorney, Agent, or Firm* — Foley & Lardner LLP

(57) ABSTRACT

A material trimmer for trimming sheet material having a blade slidingly engageable with the sheet material along a cutline and an indicator indicative of the approximate location of the cutline. The indicator provides for ready and correct orientation of the sheet material within the material trimmer. In one set of embodiments, the blade is attached to a carriage or trolley adapted for sliding translation along a portion of a guide. The guide is operatively connected to a base. The indicator is disposed in relation to a slot provided in the guide overlaying the sheet material orientated on the base. The indicator may comprise a cord operatively connected to the guide. The tension of the indicator is maintained or adjusted through manipulation of one or more tensioners operatively connected to the guide.

11 Claims, 11 Drawing Sheets

(56) References Cited

U.S. PATENT DOCUMENTS

| | | | | |
|---|---|---|---|---|
| 4,955,272 | A * | 9/1990 | Schreuders | 83/425.2 |
| 5,715,738 | A * | 2/1998 | Yetman | 83/614 |
| 5,802,942 | A | 9/1998 | Cornell et al. | |
| 6,035,755 | A | 3/2000 | Mori | |
| 6,076,446 | A * | 6/2000 | Onishi et al. | 83/487 |
| 6,223,639 | B1 | 5/2001 | Chen | |
| 6,951,159 | B2 | 10/2005 | Lin et al. | |
| 7,044,042 | B2 | 5/2006 | Schultz et al. | |
| 7,299,731 | B2 * | 11/2007 | Schulz | 83/614 |
| 2003/0233921 | A1 * | 12/2003 | Garcia et al. | 83/520 |
| 2004/0182215 | A1 * | 9/2004 | Ushiwata et al. | 83/522.15 |
| 2005/0011327 | A1 * | 1/2005 | Ushiwata et al. | 83/521 |
| 2005/0188808 | A1 * | 9/2005 | Parrish et al. | 83/522.11 |
| 2005/0199114 | A1 * | 9/2005 | Tseng | 83/522.11 |
| 2005/0252354 | A1 * | 11/2005 | Tseng | 83/614 |
| 2007/0277663 | A1 * | 12/2007 | Eby et al. | 83/651 |
| 2009/0013844 | A1 * | 1/2009 | Sudmalis et al. | 83/614 |
| 2009/0145277 | A1 * | 6/2009 | Rodriguez | 83/455 |

* cited by examiner

MATERIAL TRIMMER WITH CUT-LINE INDICATOR

CROSS REFERENCE TO RELATED PATENT APPLICATIONS

The present application claims priority to U.S. Provisional Patent Application No. 61/058,138, filed Jun. 2, 2008 and incorporated herein by reference in its entirety.

FIELD OF THE INVENTION

The present invention relates generally to the field of devices for cutting sheet material. More particularly, the present invention relates to devices for cutting sheet material including indicia representative of the cutline.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Various conventional systems for trimming sheet material are known. However, it is often difficult or time consuming to orientate and align the sheet material in these systems so that the material may be readily cut at the desired location. The inability to correctly and efficiently determine the location of the cutline using a conventional material trimmer may result in substantial waste and inefficiency.

By way of example, one type of conventional paper trimmer provides a relatively long blade rotatably attached to a base. The trimming operation is performed by progressively lowering the blade along the length of the sheet material to be trimmed. However, it is generally difficult to accurately predict the precise location of the cutline prior to cutting the sheet material using such a system. Further, orientation of the material within and operation of such systems pose substantial safety risks. Another conventional material trimming system generally comprises a blade attached to a carriage adapted to slidingly translate on a guide along the length of the sheet material. However, these systems often conceal the sheet material beneath the guide and or a bulky carriage. Again, orientation and alignment of the sheet material within these material trimmers is difficult and or imprecise and reliable detection of the cutline prior to cutting can be difficult to identify.

SUMMARY OF THE INVENTION

Various embodiments of the present invention comprise systems for efficiently cutting sheet material by providing indicia of the location of the cutline. A blade attached to a carriage engages the sheet material as the carriage is translated along a guide disposed in relation to the sheet material. A visible indicator indicative of the position of the cutline allows for effective and precise orientation of the sheet material within the material trimmer prior to cutting, thereby reducing waste.

In a set of embodiments, a material trimmer comprises a base, a guide connected to the base, a blade attached to a carriage, and an indicator that is indicative of the approximate location of the cutline on the sheet material. The indicator may be disposed in relation to a slot provided in the guide. The sheet material is orientated on the base in relation to the slot and the cutline is readily observable via the slot. The carriage is translated along the guide, engaging the blade with the underlying sheet material, thereby trimming the material. The material is precisely trimmed at the desired location by orientating the sheet material on the base in relation to the indicator.

In another set of embodiments, a material trimmer comprises a base, a guide connected to the base including one or more guide rails, a blade attached to a blade carriage that is connected to a trolley adapted for sliding along the guide rails, and an indicator that is indicative of the approximate location of the cutline on the sheet material. The indicator is disposed in relation to the guide rails. The sheet material is orientated on the base in relation to the guide rails and the cutline is readily observable via the open region between the guide rails. The trolley is translated along the guide rails, engaging the blade with the underlying sheet material, thereby trimming the material. Material is precisely trimmed at the desired location by orientating the sheet material on the base in relation to the indicator.

Various embodiments of the indicator may be used with the above embodiments. In an embodiment, the indicator comprises a cord operatively connected to the guide. The cord is constructed from metal wire; natural or synthetic fibers, string, rope, or tread; polymer line; or other suitable material. One or more tensioners may be provided to affect the tension or taughtness of the indicator. The tensioners may be adjustable so that the taughtness of the indicator can be maintained or modified. A passage may be provided in the carriage to route the indicator around the blade, while otherwise maintaining orientation of the indicator in relation to the cutline.

In another embodiment, the indicator comprises a cord operatively connected to the guide and the carriage or trolley to form a continuous loop. The indicator runs a length of the slot from the carriage or the trolley, loops around the guide at one end of the slot, returns to the opposite end of the slot to attach again to the carriage or the trolley. As the carriage or trolley is translated along the guide, the indicator accordingly traverses the loop.

In yet another embodiment, the indicator is operatively connected to the guide and a slider. The slider is adapted for sliding translation along the guide from one end of the slot to the position of the carriage or the trolley. The indicator may be retractable within the slider or the guide. The indicator may be constructed from cord or a substantially flat tape. The material trimmer may be provided with a slider and indicator on each side of the carriage or the trolley.

In still another embodiment, the indicator is operatively connected to the carriage or the trolley and a slider. The slider is adapted for sliding translation along the guide from one end of the slot to the position of the carriage or the trolley. The indicator may be retractable within the carriage or the trolley or the slider. The indicator may be constructed from cord or a substantially flat tape. The material trimmer may be provided with a slider and indicator on each side of the carriage or the trolley.

In yet another embodiment, the indicator is a slider operatively connected to the guide. The slider is adapted for sliding translation along the guide from one end of the slot to the position of the carriage or the trolley. The slider may be constructed of a clear or translucent material with a substantially opaque indicia indicative of the cutline.

In still another embodiment, the indicator comprises one or more biasing members operatively connected the guide. The biasing members include an indicator edge indicative of the cutline. The biasing members are deformable upon engagement of the carriage or the trolley permitting passage of the carriage or the trolley along a portion of the guide.

In yet another embodiment, the indicator is a plate or thin film attached to the guide or the base. The guide is substantially rigid and includes an indicator edge indicative of the cutline. A portion of the blade rides along the indicator edge.

These and other features of the invention, together with the organization and manner of operation thereof, will become apparent from the following detailed description when taken in conjunction with the accompanying drawings, wherein like elements have like numerals throughout the several drawings described below.

DETAILED DESCRIPTION OF VARIOUS EMBODIMENTS

Figure 1A:
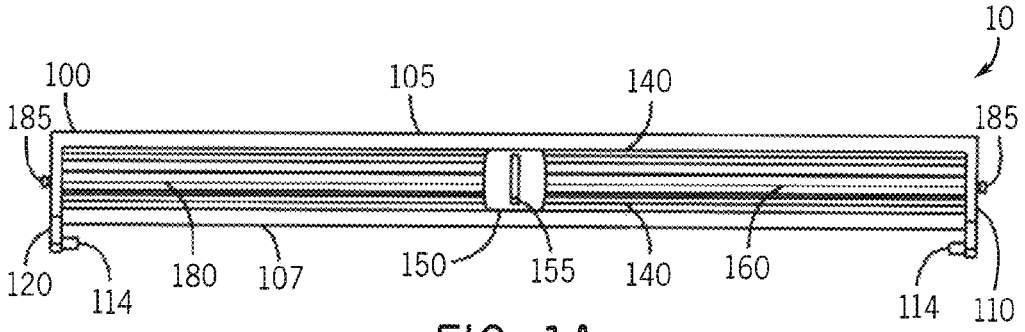
FIG. 1A is a top view of an embodiment of the material trimmer showing a guide, a carriage, and an indicator.
Figure 1B:
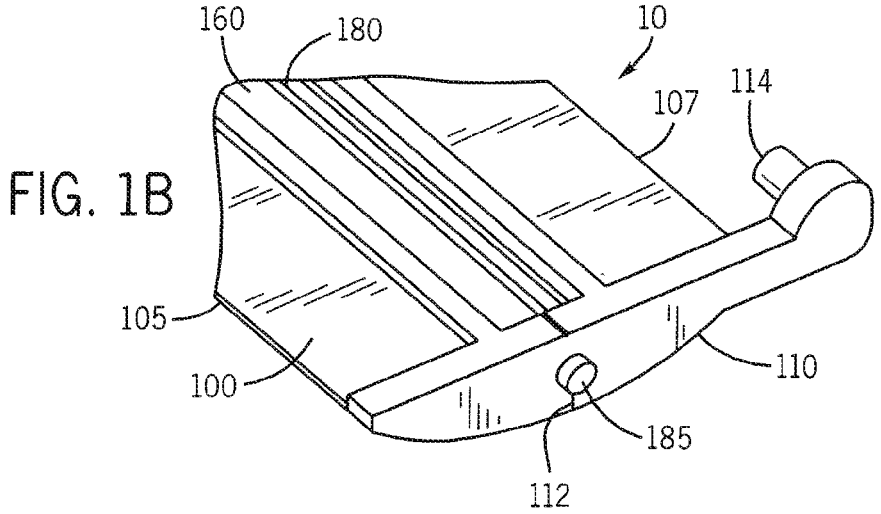
FIG. 1B is a first detailed bottom perspective view of the material trimmer of FIG. 1A.
Figure 1C:
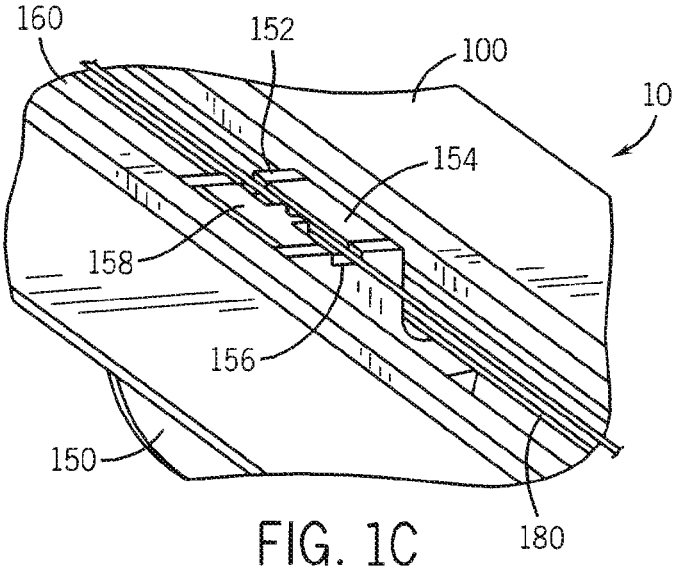
FIG. 1C is second detailed bottom perspective view of the material trimmer of FIG. 1A.

FIGS. 1A, 1B, and 1C illustrate a material trimmer 10 constructed in accordance with an embodiment of the present invention. The material trimmer 10 comprises a guide 100 operatively connected to a base (not shown) and a carriage 150 operatively connected to the guide 100. The material trimmer 10 may further comprise an indicator 180 connected to the guide 100.

As seen in FIG. 1A, the guide 100 generally comprises an elongated member comprising a leading edge 105 and a trailing edge 107 that is parallel to the leading edge 105. A first end 110 is disposed at one end of the leading edge 105 and the trailing edge 107. A second end 120 is disposed on the leading edge 105 and the trailing edge 107 substantially opposite the first end 110. The guide 100 further includes a slot 160 or other opening that runs a length of the guide 100 between the first end 110 and the second end 120 and is substantially parallel to the leading edge 105 and the trailing edge 107.

The base generally comprises a planar cutting surface sized to accept one or more sheets of material to be trimmed using the material trimmer 10. The cutting surface of the base may further include a cutting recess. The cutting recess is orientated substantially parallel to the slot 160. The guide 100 may be rotatably and operatively connected to the base and rotated between a cutting orientation and an open orientation. In the cutting orientation, the principal plane of the guide 100 is substantially parallel to the cutting surface of the base. Further, the cutting recess in the cutting surface of the base is accessible via the slot 160 when the guide 100 is in the cutting orientation. In the open orientation, the leading edge 105 is rotated away from the cutting surface of the base. Sheet material may be orientated in the material trimmer 10 on the cutting surface of the base while the guide 100 is in the open orientation. However, sheet material may also be orientated in the material trimmer 10 while the guide 100 is in the cutting orientation. The base may include additional features such as one or more alignment members, a rule, a grid or other indicia helpful in orientating the sheet material on the material trimmer 10.

In the illustrated embodiment, a coupling member 114 is disposed on each of the first end 110 and the second end 120. Corresponding holes in the base are configured to receive the coupling members 114. The guide 100 is rotatable with respect to the base about an axis passing through the coupling members 114. The first end 110 and the second end 120 may be configured such that the coupling members 114 are disposed a distance from the trailing edge 107. By configuring the material trimmer 10 in this manner, when the guide 100 is in the open orientation, the sheet material may be conveniently slid between the trailing edge 107 and the cutting surface of the base.

The carriage 150 is adapted for sliding engagement along a length of the guide 100. The carriage 150 comprises a housing 151 configured for grasping by an operator. A blade 152 (represented at 152 in FIG. 2A) or other marker is attached to the carriage 150 and extends from a bottom surface 154 of the carriage 150. The blade 152 is adapted to pass through the slot 160 when the guide 100 is in the cutting orientation and is engageable with the underlying sheet material along a substantially linear cutline. If the cutting surface includes a cutting recess, the blade 152 may be configured to extend at least partially into the cutting recess of the base. The carriage 150 may also include a grip 155 protruding from a surface substantially opposite the bottom surface 154. The grip 155 provides a grasping surface for translation of the carriage 150 along a length of the slot 160.

As further seen in FIG. 1B, the carriage 150 may include a guide block 153 that protrudes from the carriage 150 and extends at least partially into the slot 160. The guide block 153 is sized to be slidingly received in the slot 160 such that the carriage 150 may be smoothly translated along and substantially parallel to the slot 160. By minimizing the clearance between the edges of the guide block 153 and the slot 160, undesirable rotation and translation of the carriage 150 in the slot 160 can be avoided during operation of the material trimmer 10. Thus, a substantially linear cut in the sheet material may be made using the material trimmer 10. The carriage 150 may be further, or alternatively, slidingly constrained with the guide 100 by including one or more guide features 140 along a length of the guide 100. The one or more guide features 140 are adapted to mate with corresponding features (not shown) on the carriage 150. As depicted in FIG. 1A, the guide features 140 may be disposed on either, or both, the leading edge 105 and/or the trailing edge 107. As with the guide block 153, unwanted rotation and translation of the carriage 150 may be achieved through engagement of the one or more guide features 140 with the carriage 150. The material trimmer 10 may be constructed with other guiding configurations to slidingly constrain the carriage 150 with the guide 100 or the base. Further, if the guiding configuration includes a dovetail assembly, the guide 100 may include a disengagement region where the width of the slot 160 is increased to allow for removal and replacement of the carriage 150.

With reference to FIGS. 1A, 1B, and 1C, the indicator 180 is operatively connected to the guide 100 and disposed in relation to the slot 160. The indicator 180 runs at least a length of the slot 160 and orientated in relation to the guide 100 such that it is substantially indicative of the location of the where the blade 152 will engage the underlying sheet material. The indicator is generally constructed such that it is easily observable by an operator. Where the material trimmer 10 is intended for trimming paper sheet material, the indicator 180 may be conveniently constructed from or finished in a dark material for optical contrast against lighter colored paper. The indicator 180 may be a cord, where the cord is constructed from one or more metal wires; natural and or synthetic string and or thread such as nylon; polymer line, or other suitable materials.

In the embodiment of FIGS. 1A-1C, the indicator 180 is operatively connected to the guide 100 at the first end 110 and the second end 120. The indicator 180 may be connected to a tensioner 185 disposed on the guide 100. The tensioner 185 maintains the indicator 180 in a substantially taught state such that the indicator 180 provides a correct indication of the cutting location of the blade 152 over the operative life of the material trimmer 10. As depicted in FIG. 1B, the tensioner 185 is connected to the first end 110. An additional tensioner 185 may also be connected to the second end 120. The tensioner 185 may comprise a fastener rotatably connected to the first end 110 and or the second end 120. The indicator 180 is wrapped about the circumference of the tensioner 185, connected to the end of the tensioner 185, or otherwise connected to the tensioner 185. As needed, the tensioner 185 is adjusted by rotation, thereby increasing or decreasing the available length of the indicator 180 between the first end 110 and the second end 120. Alternatively, the tensioner may be constructed from a biasing member or other structure capable of maintaining the indicator 180 substantially taught.

The first end 110 and the second end 120 may include an indicator slot 112 to further orientate the indicator 180 in relation to the slot 160. Similarly, the carriage 150 may also include guiding features to assist in orientating the indicator 180 in relation to the slot 160. As illustrated in FIG. 1C, a front guide 156 and a rear guide 158 are disposed in the bottom surface 154. The front guide 156 and the rear guide 158 form a passage, biasing the indicator 180 around the blade 152 beneath the carriage 150, while maintaining the visible portion of the indicator 180 substantially in line with the blade 152.

Figure 2A:
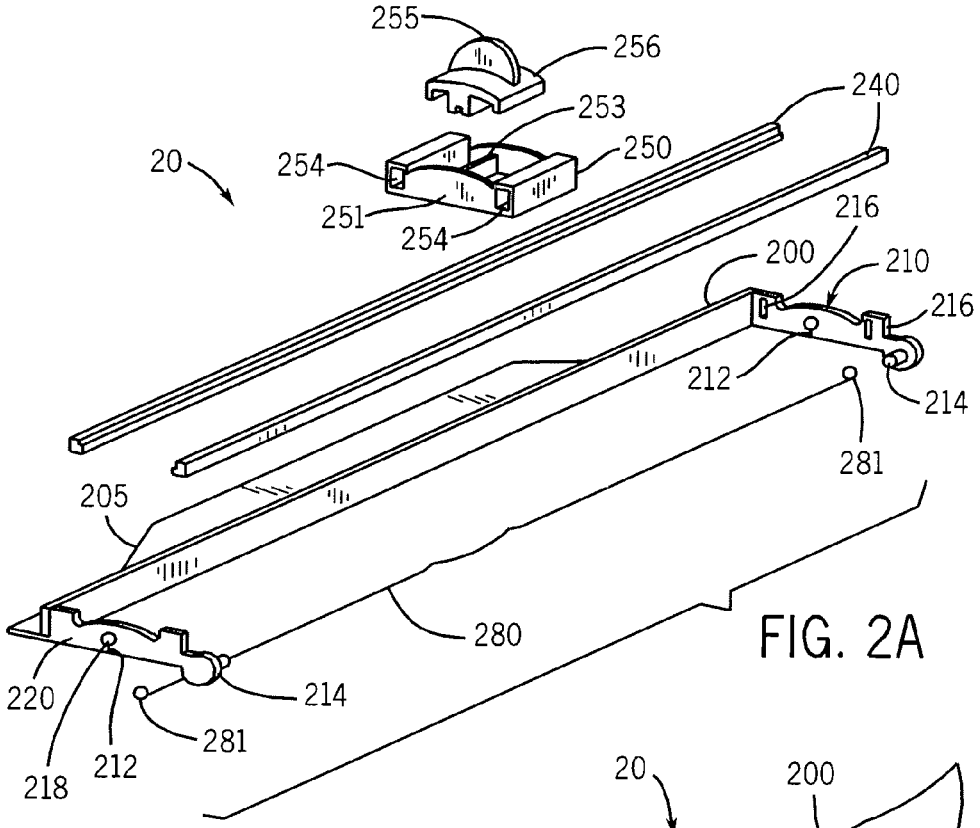
FIG. 2A is an exploded view of another embodiment of a material trimmer showing a guide, a trolley, a blade carriage, and an indicator.
Figure 2B:
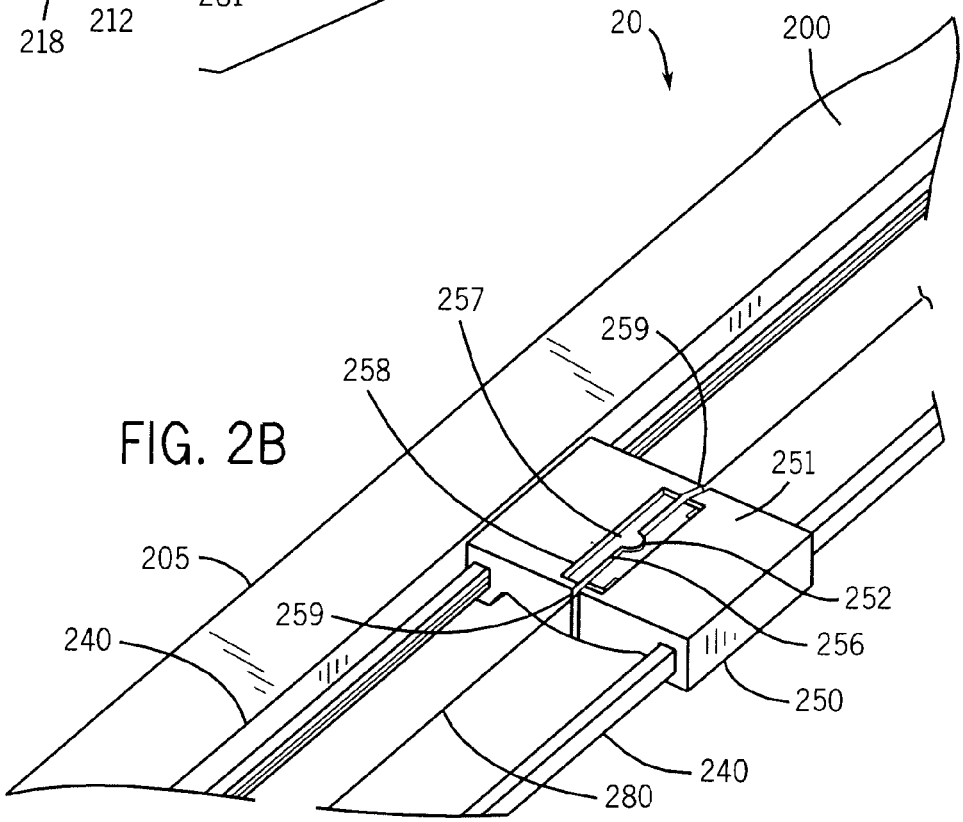
FIG. 2B is a bottom perspective view of the material trimmer of FIG. 2A.

With reference to FIGS. 2A and 2B, another embodiment is depicted. The material trimmer 20 of FIGS. 2A and 2B comprises a guide 200 operatively connected to a base (not shown) and a trolley 250 operatively connected to the guide 200. The material trimmer 20 may further comprise an indicator 280 operatively connected to the guide 200.

As depicted in FIG. 2A, the guide 200 generally comprises an elongated member comprising a leading edge 205, a first end 210 disposed at one end of the leading edge 205, and a second end 220 disposed on the leading edge 205 and substantially opposite the first end 210. The guide 200 further includes one or more rails 240 attached to the first end 210 and the second end 220 and substantially parallel to the leading edge 205. As depicted in FIG. 2A, a plurality of nests 216 are disposed on the first end 210 and the second end 220. The plurality of nests 216 are adapted to receive a portion of the one or more rails 240 and retain the one or more rails 240 in relation to the guide 200. Alternatively, or in addition to the plurality of the nests 216, the one or more rails 240 may be secured to the guide 200 with fasteners or other securing structures.

As previously described, the base generally comprises a planar cutting surface sized to accept one or more sheets of material to be trimmed using the material trimmer 20. The guide 200 may be rotatably connected to the base and rotated between a cutting orientation and an open orientation. In the cutting orientation, the principal plane of the guide 200 is substantially parallel to the cutting surface of the base. In the open orientation, the leading edge 205 is rotated away from the cutting surface of the base. Sheet material may be orientated in the material trimmer 20 on the cutting surface of the base while the guide 200 is in the open orientation. However, sheet material may also be orientated in the material trimmer 20 while the guide 200 is in the cutting orientation.

In the embodiment illustrated in FIGS. 2A and 2B, a coupling member 214 is disposed on each of the first end 210 and the second end 220. Corresponding holes in the base are configured to receive the coupling members 214. The guide 200 is rotatable in relation to the base about an axis passing through the coupling members 214. The first end 210 and the second end 220 may be configured such that the coupling members 214 are disposed a distance from the one or more rails 240. By configuring the material trimmer 20 in this manner, when the guide 200 is in the open orientation, the sheet material may be conveniently slid between the one or more rails 240 and the cutting surface of the base.

The trolley 250 is adapted for sliding translation along a length of the guide 200. The trolley 250 comprises a housing 251, a blade carriage hole 253, and one or more rail holes 254. The blade carriage hole 253 receives at least a portion of a blade carriage 256. A portion of the blade carriage 256 may nest freely within the trolley 250. The blade carriage 256 may also be secured to the trolley 250 by including corresponding mating structures (not shown) to snap-fit the blade carriage 256 with the trolley 250. The blade carriage 256 may also be secured to the trolley 250 with fasteners, a dovetail assembly, or other form of securement. As shown in FIG. 2B, a blade 252 or other marker is attached to the blade carriage 256 and extends from a bottom surface 257 of the blade carriage 256. The blade 252 is engageable with the sheet material disposed below the guide 200 along a substantially linear cutline. The blade carriage 256 may include a grip 255 protruding from a surface substantially opposite the bottom surface 257. The grip 255 provides a grasping surface for translation of the trolley 250 along a length of the guide 200. The blade carriage 256 may be constructed so that it may be removed from the trolley 250 for convenient replacement.

The one or more rail holes 254 are adapted to slidingly receive the one or more rails 240. The one or more rail holes 254 are sized such that the trolley 250 may be smoothly translated along and substantially parallel to the one or more rails 240. By minimizing the clearance between the one or more rail holes 254 and the one or more rails 240, undesirable rotation and translation of the trolley 250 can be avoided during operation. Thus, a substantially linear cut in the sheet material may be made using the material trimmer 20. The material trimmer 20 may be constructed with other guiding configurations to slidingly constrain the trolley 250 with the guide 200 or the base. For example, one or more of the rails 240 can be integrally formed with the leading edge 205.

With reference to FIGS. 2A and 2B, the indicator 280 is operatively connected to the guide 200 and disposed in relation to the trolley 250. The indicator 280 is orientated in relation to the guide 200 such that is substantially indicative of the location of where the blade 252 will engage the underlying sheet material. As previously described, the indicator is generally constructed such that it is easily observable by an operator.

In the embodiment illustrated in FIGS. 2A and 2B, the indicator 280 is connected to the guide 200 at the first end 210 and the second end 220. At one or both ends of the indicator 280, an attachment feature 281 may be included. The attachment feature 281 couples the indicator 280 to the guide at one or more locators 218 disposed on the guide 200. As previously described, the indicator 280 may be connected to a tensioner (not shown) disposed on the guide 200. The first end 210 and the second end 220 may include an indicator slot 212 to further orientate the indicator 280 in relation to the trolley 250. Similarly, the trolley 250 and the blade carriage 256 may also include guiding features to assist in orientating the indicator 280. As illustrated in FIG. 2B, a trolley guide 259 and a blade carriage guide 258 are disposed on the trolley 250 and the bottom surface 257, respectively. The trolley guide 259 and blade carriage guide 258 form a passage, biasing the indicator 280 around the blade 252 beneath the trolley 250, while maintaining the visible portion of the indicator 280 substantially in line with the blade 252 and the cutline.

Figure 3A:
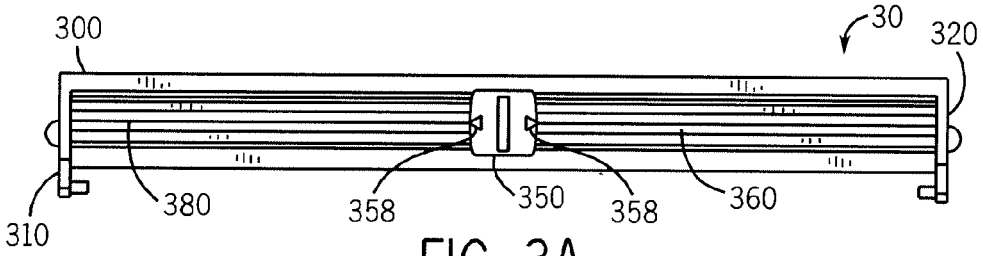
FIG. 3A is a top view of another embodiment of a material trimmer showing a guide, a carriage, and an indicator.
Figure 3B:
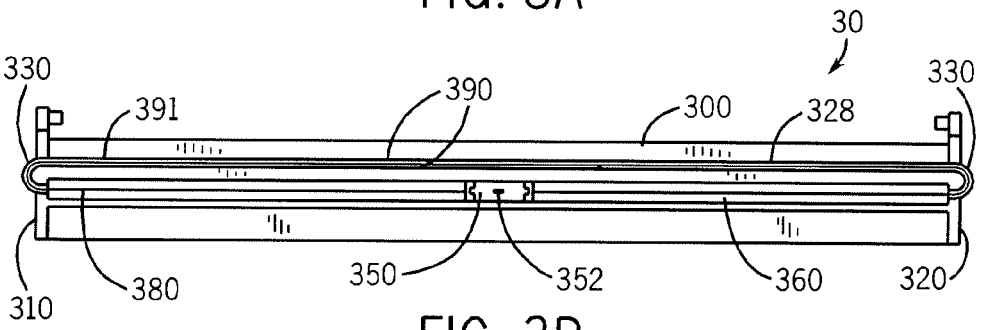
FIG. 3B is a bottom view of the material trimmer of FIG. 3A.

With reference to FIGS. 3A, 3B, 3C, and 3D, an embodiment is depicted that may be implemented with embodiments previously described and illustrated in FIGS. 1A and 2A. In the embodiment of FIGS. 3A-3D, an indicator 380 is attached to a carriage 350 and routed in relation to a guide 300. The carriage 350 is slidingly connected to the guide 300 as described above. As seen in FIG. 3B, the indicator 380 and carriage 350 form a continuous loop. The indicator 380 is routed from the carriage 350 about a first end 310 of the guide 300, along the length of the guide 300, about a second end 320 of the guide 300, returning to the carriage 350. A blade 352 or other marker is disposed on the bottom of the carriage 350 and is engageable with the underlying material along a substantially linear cutline. As the carriage 350 is translated along the guide 300 to cut the underlying sheet material, the indicator 380 correspondingly traverses the loop.

One or more attachments 358 may be provided at one or both ends of the indicator 380 to couple the indicator 380 to the carriage 350. As depicted in FIG. 3D, the carriage 350 may include one or more nests 356 to receive the one or more attachments 358. The length of the indicator 380 may be adapted such that the indicator 380 is under a slight to moderate tension so to maintain the orientation of the indicator 380 such that it is indicative of the location of the blade 352 and the cutline. Ends of the indicator 380 may also be connected to the carriage 350 with fasteners or other securing features. Alternatively, the indicator 380 itself may form a continuous loop that passes through the carriage 350, where the indicator 380 may be connected to the carriage 350 or the carriage 350 permitted to freely traverse the indicator 380.

Figure 3C:
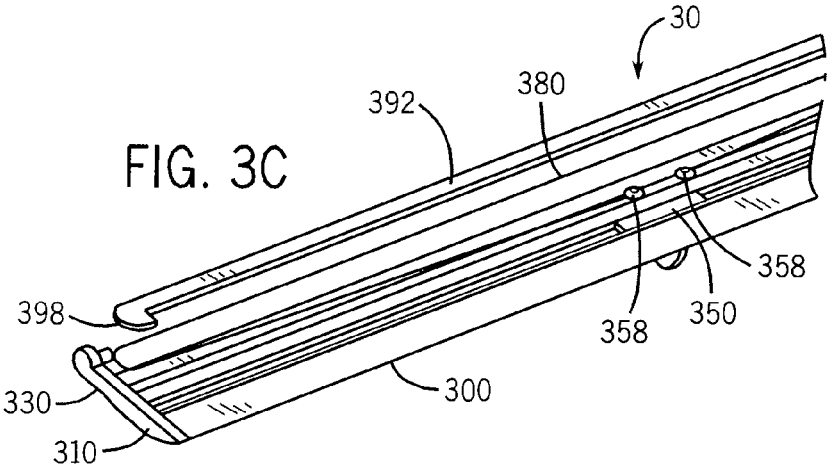
FIG. 3C is an exploded bottom perspective view of the material trimmer of FIG. 3A.
Figure 3D:
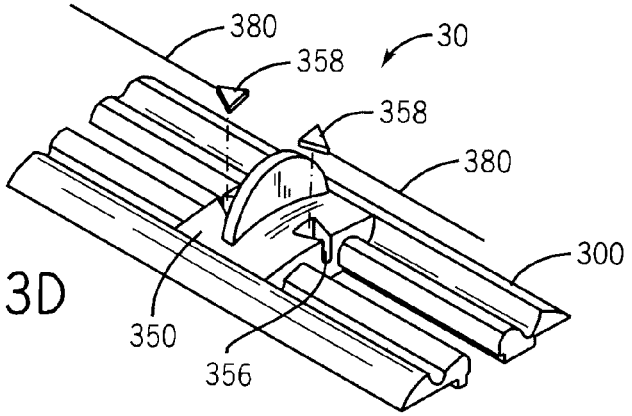
FIG. 3D is a partial exploded top perspective view of the material trimmer of FIG. 3A.

As seen in FIGS. 3B and 3C, the guide 300 may include an indicator channel 391 to at least partially house the indicator 380. The channel indicator 391 may be formed by a pair of spaced apart parallel ribs 390, comprising a straight portion 328 and a pair of curved end portions 330 disposed at the first end 310 and the second end 320. The pair of curved end portions 330 may further include a pulley or rotatable member to facilitate movement of the indicator 380. An indicator cover 392 is attachable to the guide 300 to enclose the indicator channel 391. The indicator cover 392 includes a linear portion covering the straight portion 328 and a pair of rounded portions 398 covering the pair of curved end portions 330. As described above the indicator 380 may be constructed from a number of suitable materials. The indicator 380 may be constructed such that it is sufficiently compliant for effective traversal of the pair of curved end portions 330 and the loop generally.

With reference to FIGS. 4A, 4B, 4C, and 4D, another embodiment is depicted that may be implemented with the embodiments previously described and illustrated in FIGS. 1A and 2A. In the embodiment of FIGS. 4A-4D, a carriage 450 is slidingly connected to a guide 400 of a material trimmer 40 as previously described. Additionally, a slider 485 is similarly slidingly connected to the guide 400. An indicator 480 is attached to the slider 485 at one end and at a first end 410 of the guide 400 at the opposite end. The first end 410 may include a spool 482 adapted to accept the end of the indicator 480. The orientation may be reversed to dispose the spool 482 on the slider 485 and fixing the indicator 480 to the first end 410.

Figure 4A:
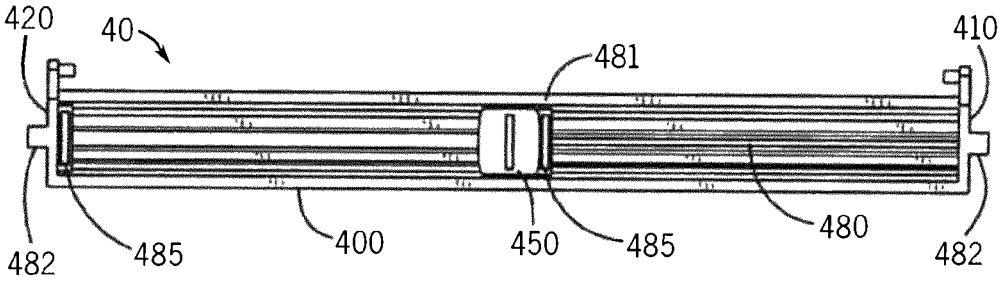
FIG. 4A is a top view of another embodiment of a material trimmer showing a guide, a carriage, a slider, and an indicator.
Figure 4B:
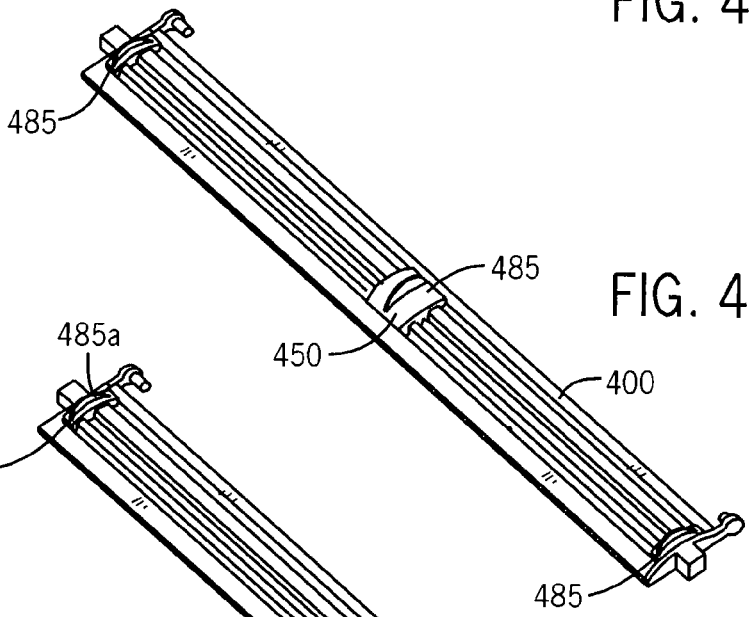
FIG. 4B is a top perspective view of the material trimmer of FIG. 4A with the indicators in the rest orientation.
Figure 4C:
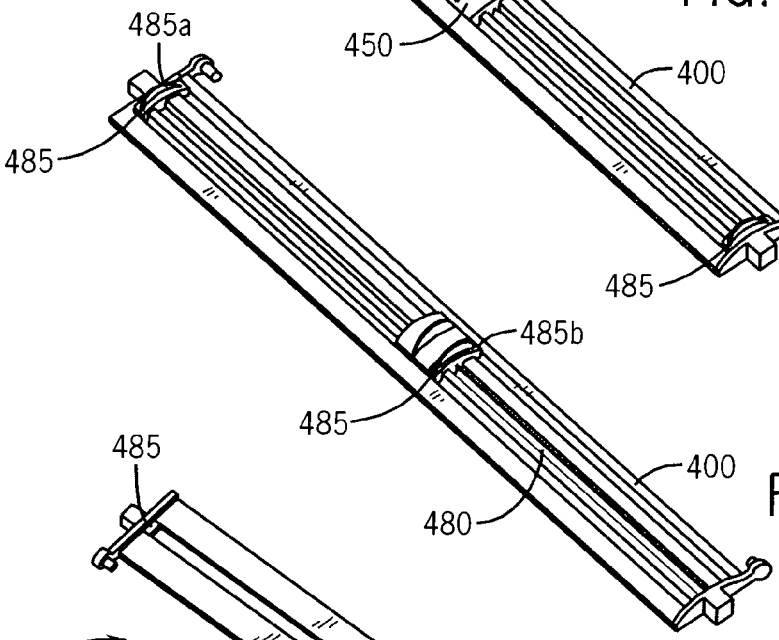
FIG. 4C is a top perspective view of the material trimmer of FIG. 4A with an indicator in the rest orientation and an indicator in extended orientation.
Figure 4D:
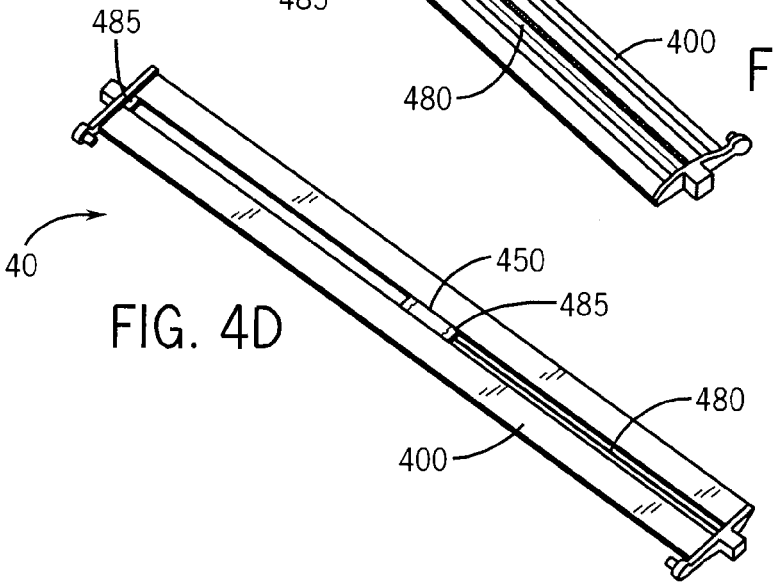
FIG. 4D is a bottom perspective view of the material trimmer of FIG. 4A.

The slider 485, the indicator 480, and the spool 482 comprise an indicator assembly. As shown in FIGS. 4A, 4B, and 4C, the material trimmer 40 may include a first indicator assembly associated with the first end 410 and a second indicator assembly associated with a second end 420. The slider 485 can include a grip 481 extending from the slider 485 for manipulation of slider 485. The slider 485 can also be constructed to nest or couple to the carriage 450 for convenient simultaneous operation of the carriage 450 and the slider 485. The carriage 450 and the slider 485 are independently operable.

The slider 485 is moveable along the guide 400 between a rest position, indicated as 485*a*, and an active position, indicated as 485*b*, in FIG. 4C. In the rest position 485*a*, the indicator 480 is retracted on the spool 482. In the active position 485*b*, the indicator 480 is at least partially extended from the spool 482 to the slider 485. The slider 485 and indicator 480 are fully extendable between the first end 410 or the second end 420 and the carriage 450. The indicator 480 may be constructed of a substantially elastic member that capable of self-retracting onto the spool 482. Alternatively, the spool 482 may include a biasing member represented at 483 in FIG. 4A such as a coil spring to retract the indicator 480 onto to the spool 482. The indicator 480 may comprise a substantially clear or translucent portion attached to a central or offset indicating portion. The indicating portion may be substantially opaque or otherwise indicative of the location where the blade or other marker will engage the underlying sheet material.

Figure 5A:
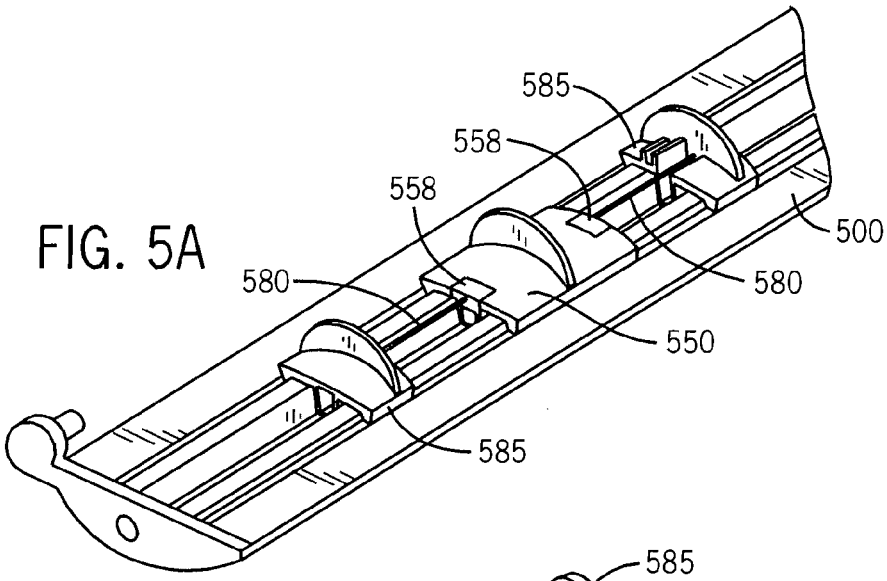
FIG. 5A is a top view of another embodiment of a material trimmer showing a guide, a carriage, a slider, and an indicator.
Figure 5B:
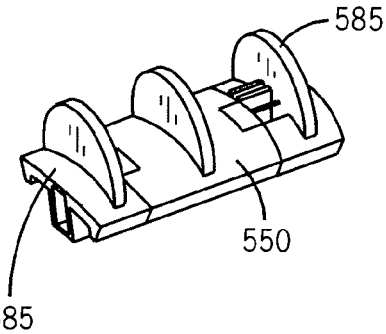
FIG. 5B is a detailed perspective view of the carriage and the sliders in the retracted orientation of the material trimmer of FIG. 5A.
Figure 5C:
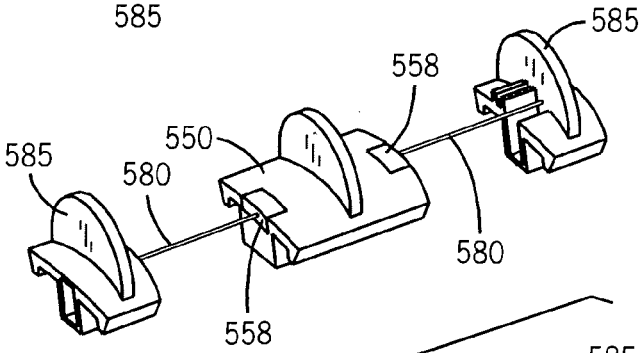
FIG. 5C is a detailed perspective view of the carriage and the sliders in the extended orientation of the material trimmer of FIG. 5A.
Figure 5D:
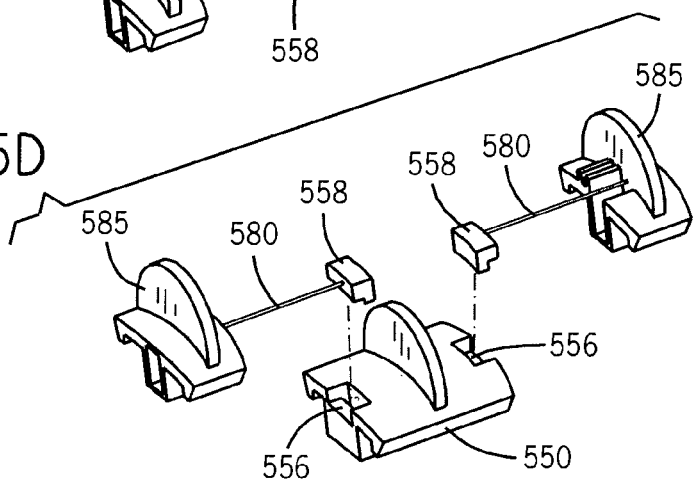
FIG. 5D is an exploded view of the carriage and the sliders of the material trimmer of FIG. 5A.

With reference to FIGS. 5A, 5B, 5C, and 5D, another embodiment is depicted that may be implemented with the embodiments previously described and illustrated in FIGS. 1A and 2A. In the embodiment of FIGS. 5A-5D, a carriage 550 is slidingly connected to a guide 500 of a material trimmer as previously described. Additionally, a slider 585 is similarly slidingly connected to the guide 500. An indicator 580 is attached to the slider 585 at one end and is attachable to the carriage 550 at the opposite end. The indicator 580 may include an attachment 558 capable of attaching the indicator 580 to the carriage 550. The carriage 550 may include a corresponding nest 556 adapted to receive the attachment 558. The attachment 558 and the corresponding nest 556 may be configured to provide a releasable snapping connection to attach the indicator 580 to the carriage 550, as depicted in FIG. 5D.

The slider 585, the indicator 580, and the attachment 558 comprise an indicator assembly. As shown in FIGS. 5A, 5C, and 5D, the material trimmer 50 may include a first indictor assembly disposed on one side of the carriage 550 and a second indicator assembly disposed on the opposite side of the carriage 550. The slider 585 can include a grip 581 extending from the slider 585 for manipulation of the slider 585. The slider 585 can also be constructed to nest or couple to the carriage 550 for convenient simultaneous translation of the carriage 550 and the slider 585. The carriage 550 is operable independent of the slider 585.

The slider 585 is translatable along the guide 500 in relation to the carriage 550. As shown in FIG. 5B, the slider 585 can be positioned on the guide 500 (not shown) in a retracted orientation adjacent to the carriage 550. As shown in FIGS. 5A and 5C, the slider 585 can be translated along the guide 500 to an extended orientation disposed away from the carriage 550. In the retracted orientation the, the indicator 580 is retracted within the slider 585. In the extended orientation, the indicator 580 is at least partially extended from the slider 585 to the carriage 550. The slider 585 may be equipped with a locking feature adapted to secure the slider 585 at a desired location on the guide 500. The slider 585 and indicator 580 are fully extendable between the guide end and the carriage 550. The indicator 580 may be constructed of a substantially elastic member that is self retracting into the slider 585. Alternatively, the slider 585 may include a biasing member (not shown) such as a coil spring to retract the indicator 580 into the slider 585. The indicator 580 may comprise a substantially clear or translucent portion attached to a central or offset indicating portion. The indicating portion may be substantially opaque or otherwise indicative of the location where the blade or other marker will engage the underlying sheet material.

Figure 6A:
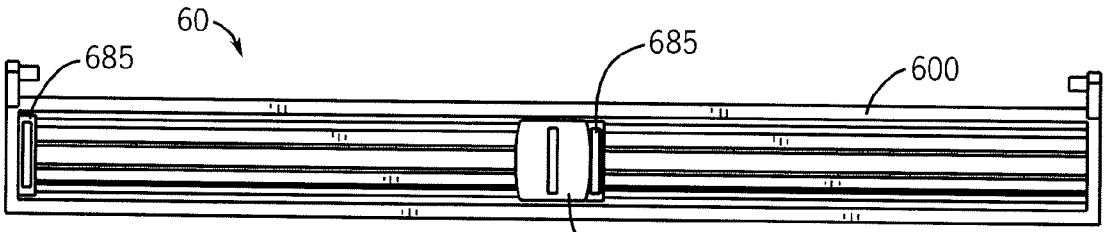
FIG. 6A is a top view of another embodiment of a material trimmer showing a guide, a carriage, and a slider indicator.
Figure 6C:
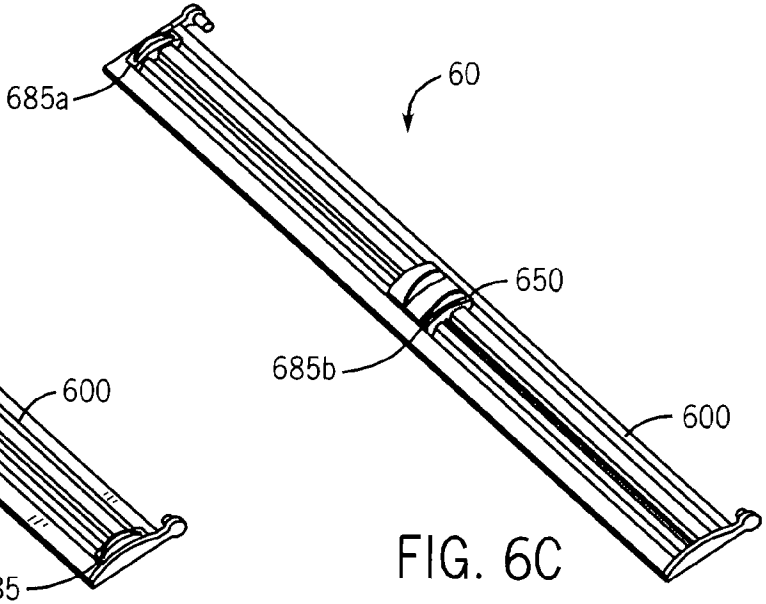
FIG. 6C is a bottom perspective view of the material trimmer of FIG. 6A.
Figure 6B:
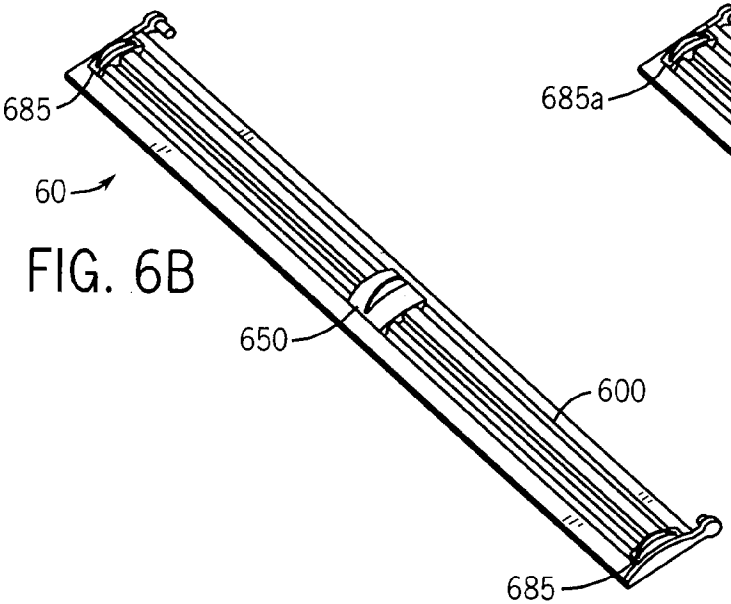
FIG. 6B is a top perspective view of the material trimmer of FIG. 6A.
Figure 6D:
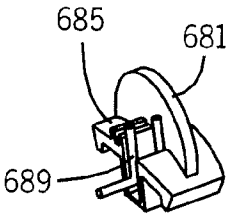
FIG. 6D is a detailed perspective view of the slider indicator of the material trimmer of FIG. 6A.

With reference to FIGS. 6A, 6B, 6C, and 6D, another embodiment is depicted that may be implemented with the embodiments previously described and illustrated in FIGS. 1A and 2A. In the embodiment of FIGS. 6A-6D, a carriage 650 is slidingly connected to a guide 600 of a material trimmer 60 as previously described. Additionally, a slider indicator 685 is similarly slidingly connected to the guide 600. As shown in FIGS. 6A, 6B, and 6C the material trimmer 60 may include one or more slider indicators 685 disposed on each side of the carriage 650. As seen in FIG. 6D, the slider indicator 685 can include a grip 681 extending from the slider indicator 685 for manipulation of slider 685. The slider indicator 685 may be constructed from a substantially transparent or translucent material. The slider indicator 685 may further include indicia representative of the location of where the blade or other marker disposed on the carriage 650 will engage the underlying sheet material along a cutline, such as a line 689.

The slider indicator 685 is translatable along the guide 600 in relation to the carriage 650. As shown in FIG. 6C, the slider 685 can be positioned on the guide 600 between a rest orientation, indicated by 685*a*, and an active orientation, indicated by 685*b*. In typical operation, sheet material to be cut is placed beneath the guide 600. Next, an operator translates one or more of the slider indicator 685 between the rest orientation 685*a* and the active orientation 685*b* to assess alignment of the underlying sheet material in relation to the carriage 650. The orientation of the sheet material can be adjusted to compensate for any misalignment. The alignment assessment and adjustment operations can be repeated as necessary. Once the sheet material is aligned, the operator translates the carriage along a portion of the guide 600 to cut the desired portion of the sheet material.

With reference to FIGS. 7A, 7B, 7C, 7D, 8A, 8B, and 8C, another embodiment is depicted that may be implemented with the embodiments previously described and illustrated in FIGS. 1A and 2A. In the embodiment of FIGS. 7A-7D and 8A-8C, a carriage 750 is slidingly connected to a guide 700 of a material trimmer 70 as previously described. A plurality of biasing indictors 780 are operatively connected to the guide 700. The plurality of biasing indictors 780 include an indicating edge 781 observable through a slot 760 in the guide 700. The indicating edge 781 is indicative of the location where a blade 752 or other marker disposed on the carriage 750 is engageable with the sheet material underlying the slot 760.

Figure 7A:
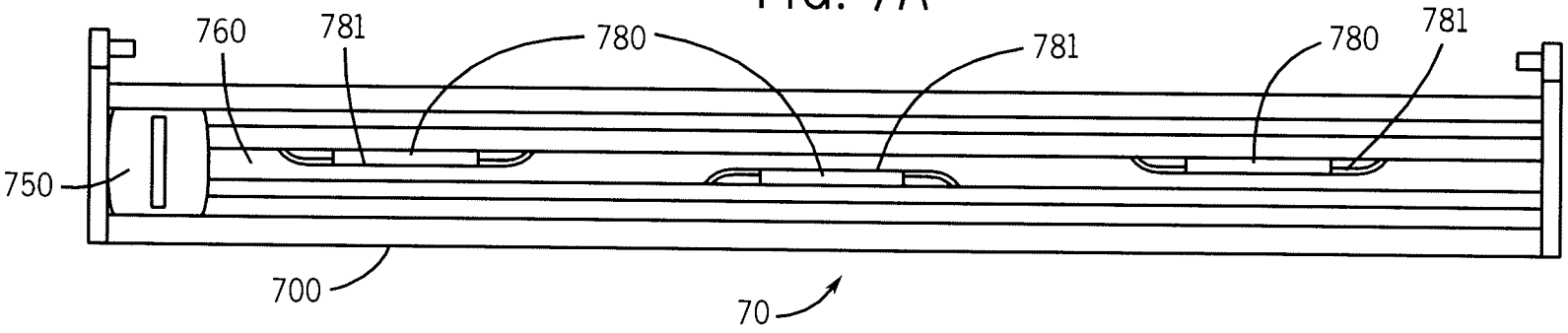
FIG. 7A is a top view of another embodiment of a material trimmer showing a guide, a carriage, and a biasing indicator.
Figure 7B:
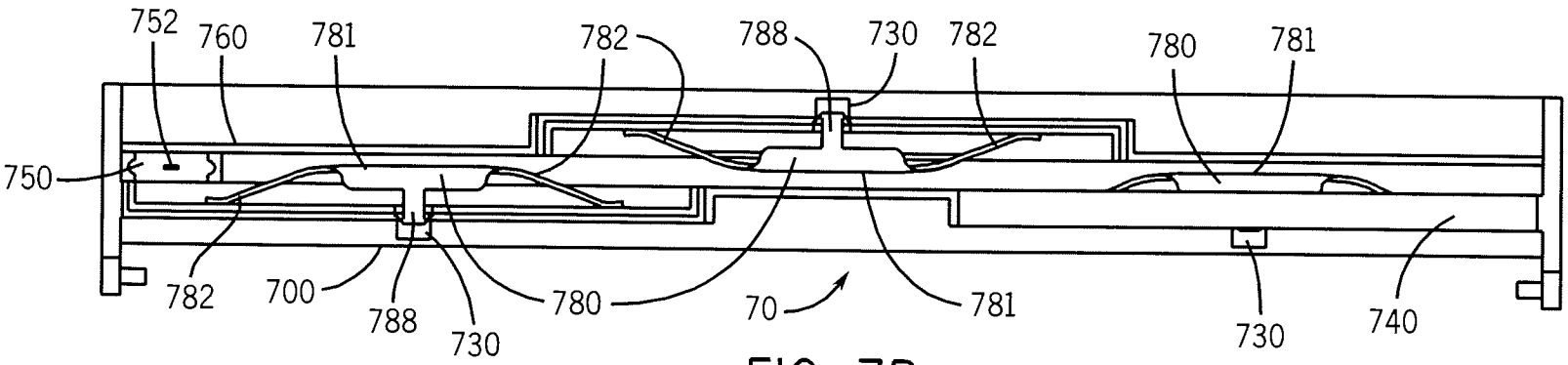
FIG. 7B is a bottom view of the material trimmer of FIG. 7A.
Figure 7C:
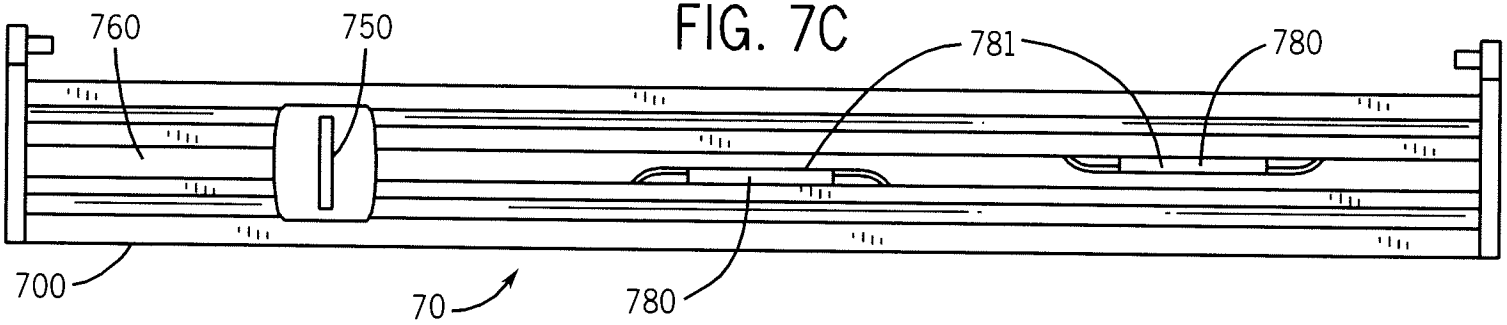
FIG. 7C is a top view of the material trimmer of FIG. 7A showing the carriage in an extended orientation.
Figure 7D:
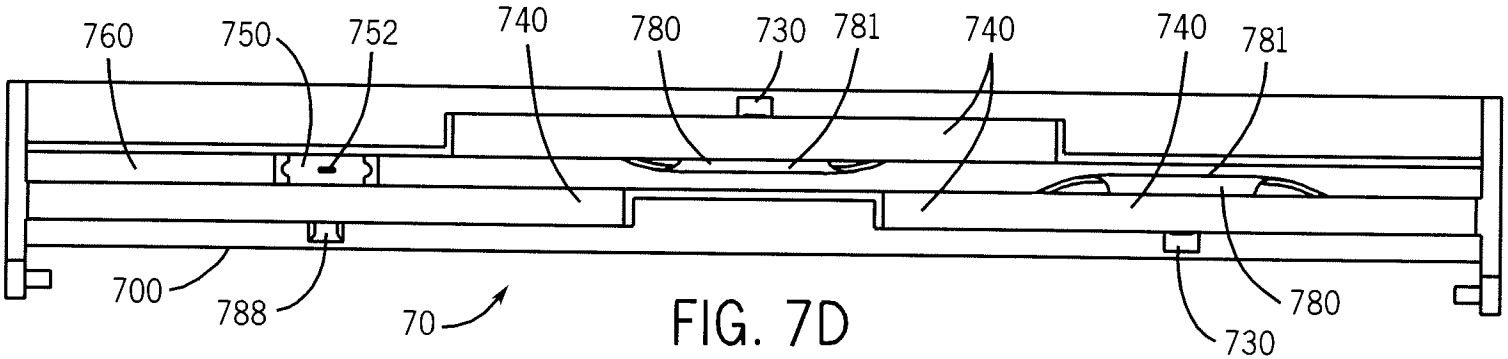
FIG. 7D is a bottom view of the material trimmer of FIG. 7A showing the carriage in an extended orientation.

The plurality of biasing indictors 780 may further include one or more deflecting portions 782 and one or more displacement guides 788. As indicated in FIGS. 7C and 7D, the plurality of biasing indictors 780 are retained in relation to the guide 700 by one or more biasing indicator covers 740. The guide 700 may further include one or more recesses 730 adapted to receive at least a portion of the one or more displacement guides 788.

Figure 8A:
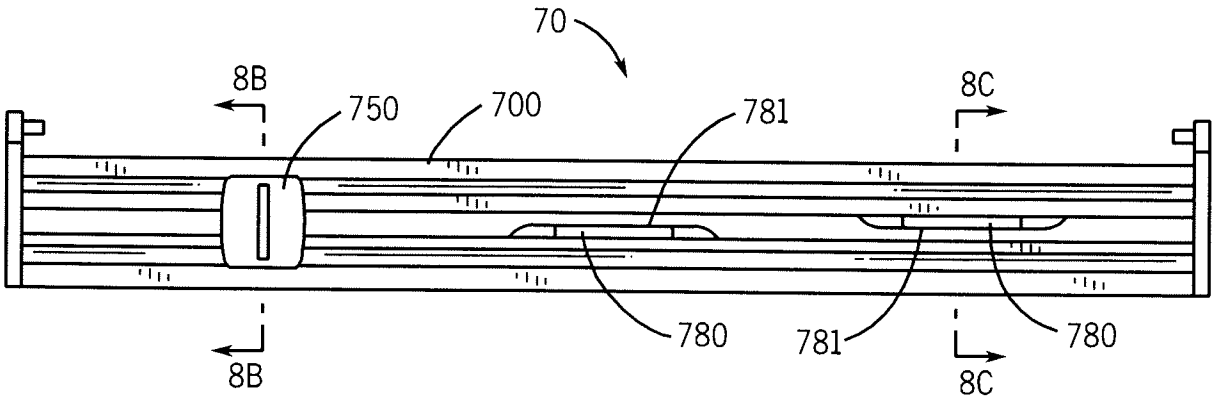
FIG. 8A is a top view of the material trimmer of FIG. 7A.
Figure 8C:
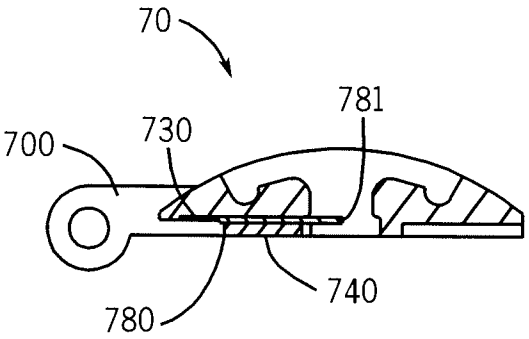
FIG. 8C is a detailed cross-section of the material trimmer of FIG. 8A showing the biasing indicator in the relaxed orientation.
Figure 8B:
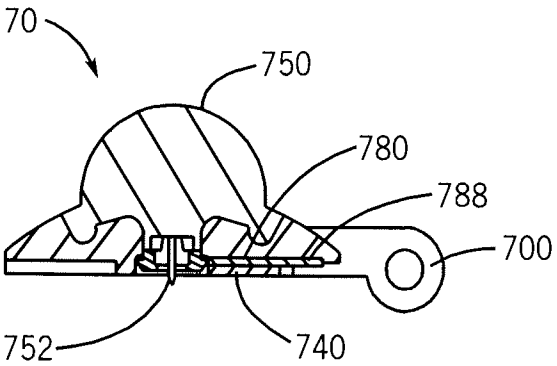
FIG. 8B is a detailed cross-section of the material trimmer of FIG. 8A showing the biasing indicator in the compressed orientation.

The one or more deflecting portions 782 deflect when the carriage 750 encounters one of the plurality of biasing indicators 780. Accordingly, as shown in FIGS. 7C and 7D, one of the plurality of biasing indicators 780 is translated substantially out of the slot 760 and out of the path of the carriage 750. Simultaneously, the displacement guide 788 is received in the recess 730, directing the translation path of one of the plurality of biasing indicators 780 to its compressed orientation. As the carriage 750 is further translated, the one or more deflecting portions 782 return one of the plurality of biasing indicators 780 to its relaxed orientation. FIGS. 8B and 8C further illustrate one of the plurality of the biasing indicators 780 in the compressed orientation and relaxed orientation, respectively. The plurality of biasing indicators 780 may be constructed from a variety of materials including cast, stamped, or machined metal as well as injection molded or machined plastic.

Figure 9A:
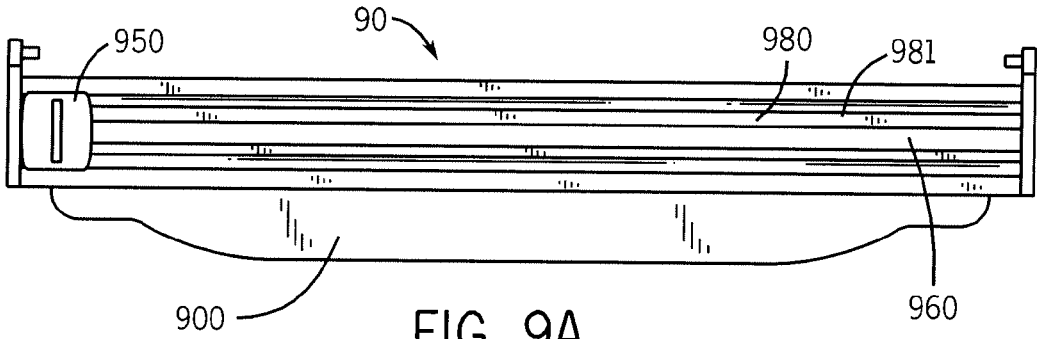
FIG. 9A is a top view of another embodiment of a material trimmer showing a guide, a carriage, and an indicator plate.
Figure 9B:
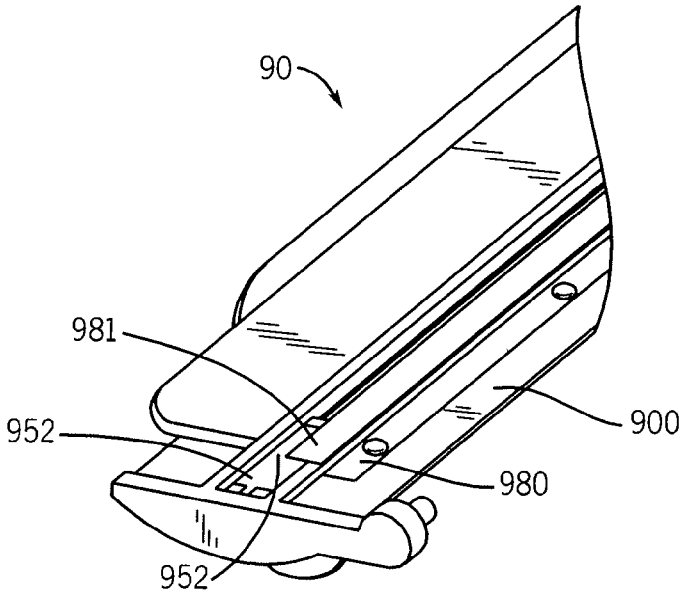
FIG. 9B is a bottom perspective view of the material trimmer of FIG. 9A.

With reference to FIGS. 9A and 9B, another embodiment is depicted that may be implemented with the embodiments previously described and illustrated in FIGS. 1A and 2A. In the embodiment of FIGS. 9A and 9B, a carriage 950 is slidingly connected to a guide 900 of a material trimmer 90 as previously described. An indictor plate 980 is attached to the guide 900 and includes an indicator edge 981. The indicator plate 980 may comprise a plate, a thin film, or other suitable structure. The carriage 950 includes a blade 952 or other marker that accesses the sheet material to be cut underlying a slot 960 in the guide 900. The indicator edge 981 is disposed over at least a length of the slot 960. A portion of the blade 952 rides along the indicator edge 981, directing the path of the blade 952 over a substantially linear cutline along the underlying sheet material. The indicator edge 981 is indicative of the cutline where the blade 952 will engage the underlying sheet material. In the embodiment of FIGS. 9A and 9B, the carriage 950 may be adapted to float on the guide 900, relying solely, or in part, on the engagement a portion of the blade 952 with the indicator edge 981 to constrain translation of the carriage 950.

Figure 10:
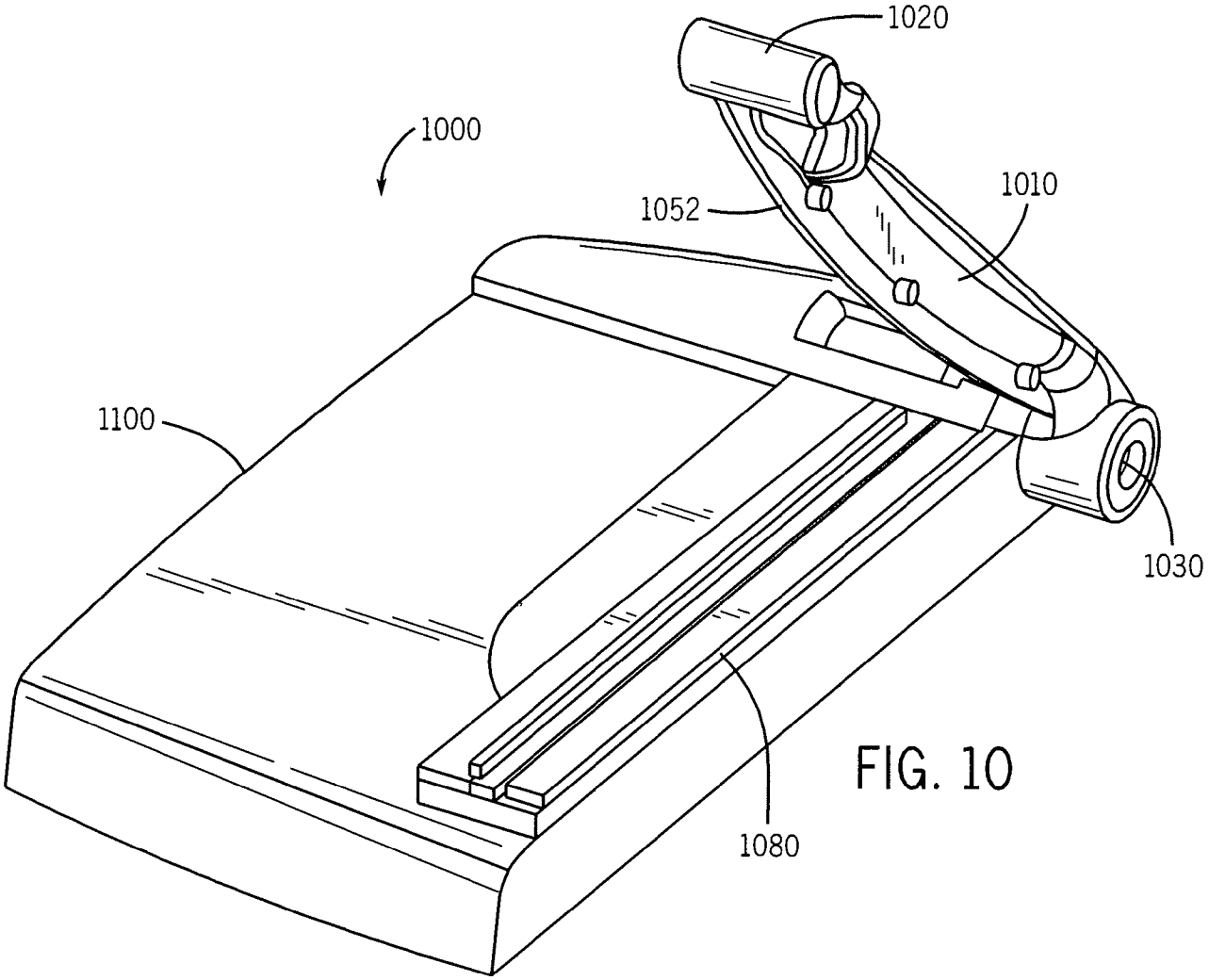
FIG. 10 is an isometric view of yet another embodiment of a material trimmer showing a base, an arm, and an indicator.

With reference to FIG. 10, yet another embodiment is depicted. In the embodiment of FIG. 10, a material trimmer 1000 is depicted comprising a blade 1052 operatively connected to an arm 1010 which is rotatably connected to the base 1100 at a hinge 1030. The material trimmer 1000 may further include an indicator 1080 operatively connected to the base 1100. A grip 1020 may further be disposed on the arm 1010 to facilitate safe and efficient operation of the material trimmer 1000.

In the embodiment of FIG. 10, sheet material is orientated on the base 1100 below the indicator 1080 such that the intended cutline is substantially aligned with the indicator 1080. The blade 1052 is generally elongated such the sheet material is trimmed by way of progressive rotation of the blade 1052 toward the base 1100. Accordingly, the arm 1010 is rotated about hinge 1030 to bring the blade 1052 into engagement with the sheet material, thereby trimming the sheet material at the intended cutline.

Embodiments of the present invention may be particularly useful for efficiently and precisely trimming paper materials. However, one skilled in the art will appreciate that the present invention is not limited to trimming paper materials but may be employed to cut a variety of relatively thin sheet materials, including fabrics, polymer and rubber type materials, metals, and woods. Additionally, it will be appreciated that multiple layers of the same or different materials may be cut simultaneously using the present invention.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described to explain the principles of the present invention and its practical application to enable one skilled in the art to utilize the present invention in various embodiments and with various modifications as are suited to the particular use contemplated.

What is claimed is:

1. A material trimmer for trimming sheet material comprising:

a base;

a blade configured to cut one or more pieces of sheet material orientated on the base, the blade operatively connected to the base;

a guide movably rotatably connected to the base between a cutting orientation and a noncutting orientation, the guide including a slot therein through which the blade passes, the slot having a first end and a second end; and a carriage, the carriage slidingly movable along the guide, where in the blade is mounted on the carriage, an indicator operatively connected to the guide and disposed over the one or more pieces of sheet material when the guide is in the cutting orientation, the indicator comprising a cord running along a length of the slot from the first end to the second end, the cord being substantially axially fixed such that it does not advance along its own axis, and wherein the indicator is viewable by a user of the material trimmer through the slot and indicative to the user of the approximate location of a cutline formable in the one or more pieces of sheet material upon engagement with the blade, and further comprising an indicator passage disposed on the carriage, where the indicator passage routes the indicator about the blade.

2. The material trimmer of claim 1, wherein a portion of a plane formed by the cutline and the indicator passes through the slot.

3. The material trimmer of claim 1, further comprising at least one rail disposed along a portion of the guide, wherein the carriage comprises: a trolley including one or more holes adapted to slidingly receive the at least one rail; and a blade carriage, the blade carriage operatively connected to the trolley, and wherein the blade is attached to the blade carriage.

4. The material trimmer of claim 1, further including a tensioner operatively connected to the guide, wherein the indicator includes a first end and a second end, and wherein at least the first end is operatively connected to the tensioner.

5. The material trimmer of claim 4, wherein the tensioner is rotatably engageable with the guide, and wherein rotation of the tensioner affects the tension of the indicator.

6. The material trimmer of claim 4, wherein the tensioner comprises a biasing member.

7. The material trimmer of claim 1, wherein the blade is rotatably connected to the base.

8. A material trimmer for trimming sheet material comprising:

a base;

a guide rotatably connected to the base, the guide including a slot through which the sheet material may be viewed when the sheet material is positioned between the base and the guide;

a carriage including a blade configured to cut one or more pieces of sheet material orientated on the base and accessible by the blade via the slot, the carriage slidingly moveable along a portion of the guide; and an indicator having a first end and a second end, the indicator viewable by a user during a cutting operation and comprising a cord running along a length of the slot of the guide, the first end and the second end of the indicator coupled to the guide, the cord being substantially axially fixed such that it does not advance along its own axis, and wherein the visible location of the indicator is indicative to the user of the approximate location of a cutline formable in the one or more pieces of sheet material upon engagement with the blade, and further comprising an indicator passage disposed on the carriage, where the indicator passage routes the indicator about the blade.

9. The material trimmer of claim 8, further including a tensioner operatively connected to the guide, wherein at least the first end is operatively connected to the tensioner.

10. The material trimmer of claim 9, wherein the tensioner is rotatably engageable with the guide, and wherein rotation of the tensioner affects the tension of the indicator.

11. The material trimmer of claim 9, wherein the tensioner comprises a biasing member.

* * * * *